US008256027B2

(12) United States Patent
Pedersen et al.

(10) Patent No.: US 8,256,027 B2
(45) Date of Patent: Sep. 4, 2012

(54) UPPER BODY SHAPEWEAR UNDERGARMENT

(76) Inventors: Amy Blankenship Pedersen, Marietta, GA (US); Jennifer Pedersen Daniels, Marietta, GA (US)

( * ) Notice: Subject to any disclaimer, the term of this patent is extended or adjusted under 35 U.S.C. 154(b) by 1024 days.

(21) Appl. No.: 12/283,697

(22) Filed: Sep. 15, 2008

(65) Prior Publication Data

US 2009/0098801 A1 Apr. 16, 2009

Related U.S. Application Data

(60) Provisional application No. 60/998,803, filed on Oct. 15, 2007.

(51) Int. Cl.
*A41B 9/00* (2006.01)

(52) U.S. Cl. ..... 2/109; 450/1

(58) Field of Classification Search ..... 2/73, 75, 2/105, 106, 107, 109, 110, 113–115; 450/1–32, 450/70

See application file for complete search history.

(56) References Cited

U.S. PATENT DOCUMENTS

| | | | | |
|---|---|---|---|---|
| 4,596,253 | A | 6/1986 | Griffith | |
| 4,625,338 | A * | 12/1986 | Starling | 2/106 |
| 5,667,422 | A * | 9/1997 | Erwin | 450/30 |
| 5,765,224 | A | 6/1998 | Johnson | |
| 5,772,492 | A * | 6/1998 | Erwin | 450/30 |
| 5,915,531 | A * | 6/1999 | Hilpert et al. | 2/69 |
| 5,937,442 | A | 8/1999 | Yamaguchi et al. | |
| 6,000,993 | A * | 12/1999 | Erwin | 450/7 |
| 6,061,832 | A * | 5/2000 | Morrison, Jr. | 2/78.1 |
| 6,520,926 | B2 | 2/2003 | Hall | |
| 2007/0094765 | A1 * | 5/2007 | Summers et al. | 2/113 |

* cited by examiner

*Primary Examiner* — Gloria Hale
(74) *Attorney, Agent, or Firm* — Fay Sharpe LLP

(57) ABSTRACT

A shapewear undergarment for a woman, more particularly to an upper body shapewear undergarment with arm compression that gently lifts and compresses flabby areas on the top half of the body, especially the arms, midriff and back. The overall design provides the user with a smoother, toner appearance.

18 Claims, 3 Drawing Sheets

UPPER BODY SHAPEWEAR UNDERGARMENT

The invention of this application relates to a shapewear undergarment for a woman, more particularly to an upper body shapewear undergarment with arm compression. This application claim priority in Provisional Patent application Ser. No. 60/998,803 filed on Oct. 15, 2007 which is incorporated by reference herein.

INCORPORATION BY REFERENCE

The invention of this application relates to shapewear undergarments. The Yamaguchi et al. U.S. Pat. No. 5,937,442 discloses a shoulder and arm support garment that covers the upper body of a human and is incorporated by reference herein for showing the same. The Hall U.S. Pat. No. 6,520,926 discloses a compression support sleeve designed to prevent migration of the garment on the skin of the wearer during exercise and is incorporated by reference herein for showing the same. The Johnson U.S. Pat. No. 5,765,224 discloses a body support garment that creates an hourglass torso shape at the waist and is incorporated by reference herein for showing the same. The Griffith U.S. Pat. No. 4,596,253 discloses an undergarment and is incorporated by reference herein for showing the same.

BACKGROUND

This invention relates to a shapewear undergarment, more particularly to an upper body shapewear undergarment with arm compression that gently lifts and compresses the flabby areas on the top half of the body, especially the arms, midriff and back. Garments improving the shape of a woman, often referred to as shapewear, help boost a woman's confidence by flattering her figure. For the most part, women's shapewear undergarments available today primarily address women's problem areas from the waist down. Few shapewear garments address trouble areas on the top half. Those that do typically focus on a select area, namely the midriff and/or the back. The invention of this application, however, provides a comfortable solution for improving the appearance of the arms, midriff and back.

Originally, shapewear undergarments were designed to slim a woman's midriff or buttocks and thighs. These products would provide a smoothing solution, however, when the wearer moved, the product tended to roll up making it (1) unable to solve the problem and (2) uncomfortable to wear. Further, a garment designed for the top half of a woman's body usually has chest coverage that compresses, rather than supports, the breasts. This is an area that most women prefer not to minimize. Finally, the cut and trim of many of these traditional garments force the fat to be displaced. This can result in additional bulges, around the bra line or waist, for example, creating unsightly rolls of fat, rather than providing a smooth, streamlined appearance. Therefore, there is a need for a product to comfortably contour a woman's torso. First, to help slim a woman's middle section, both front and back; second, to slim a woman's arms, particularly her upper arms as well as her back fat.

Few shapewear undergarments include sleeves for arm compression. Those that do, have missed executionally and operationally. The sleeves have been made of a hosiery material and rip when the wearer tries it on. Further, the seam on these garments has not been reinforced and creates holes when the wearer puts it on. While the intention is for the garment to smooth out the fat, the fat remains in its natural state in the area where the seam has ripped resulting in a lumpy appearance. The product has not successfully met the need. Further, these garments typically lack coverage in the midriff and back areas, an area of complaint for many women.

U.S. Pat. No. 5,937,442 discloses a shoulder and arm support garment that covers the upper body of a human. One of the objectives of this design is to prevent and treat shoulder joint or muscle disorders rather than being addressed to a compression tool to shape the wearer's body. U.S. Pat. No. 6,520,926 references a compression support sleeve designed to prevent migration of the garment on the skin of the wearer during exercise. U.S. Pat. No. 5,765,224 discloses a body support garment that creates an hourglass torso shape at the waist but does not address the need for arm control as well. U.S. Pat. No. 4,596,253 too addresses abdominal support via three elastic webs but does not address the back and arms through cosmetic reshaping. None of these patents show the complete control of the torso and arms that is needed to properly shape a women's body.

Accordingly, a need exists for a comfortable shapewear undergarment that gently compresses the torso, namely the arms, back and midriff, to help minimize or eliminate the appearance of fat bulges.

SUMMARY OF THE INVENTION

The invention of this application relates to shapewear and, more particularly, to upper body shapewear which can include arm compression, a seamless body with a ribbed midriff and/or a smooth back feature. The invention can further include two smooth sleeves sewn to the bodice at the shoulder.

In one embodiment, the invention features a "neck line" that scoops below the breasts to prevent compression of this area or, alternatively, chest coverage that supports, not constricts, this area.

In another embodiment, the invention can include more than one of these features thereby producing a garment with gentle compression throughout and that gently lifts and supports the flabby areas of the top half of the wearer's body giving a toner and trimmer appearance.

Besides the objects and advantages of the upper body shapewear for women with arm compression described above, several objects and advantages of the present invention are:

(a) to provide a 1-3" hem that falls below the woman's middle, where fat rolls tend to encourage movement of the shapewear garment. Rather, this hem fits snuggly yet comfortably well below her navel;
(b) to provide sleeves with reinforced seams to smooth out and support the wearer's arm fat producing a streamlined appearance;
(c) to provide a ribbed midriff for additional compression and support to help the garment stay in place;
(d) to provide a smooth top half of the garment to minimize the appearance of bra lines;
(e) to provide a scooped neck line below the woman's breasts to prevent compression in an area where women typically do not want minimized;
(f) or, alternatively, to provide moderate coverage in the chest area for women for gentle support for those endowed women that long for extra support.

Further objects and advantages are to provide a solution to smooth out fat on the top half of the body, which is easy to step in and out of, which can be machine washed for multiple wears. Still further objects and advantages will become apparent from a consideration of the ensuing description and drawings.

BRIEF DESCRIPTION OF THE DRAWINGS

The foregoing will in part be obvious and in part be pointed out more fully hereinafter in connection with a written description of preferred embodiments of the present invention illustrated in the accompanying drawings in which.

DESCRIPTION OF PREFERRED EMBODIMENTS

Figure 1:
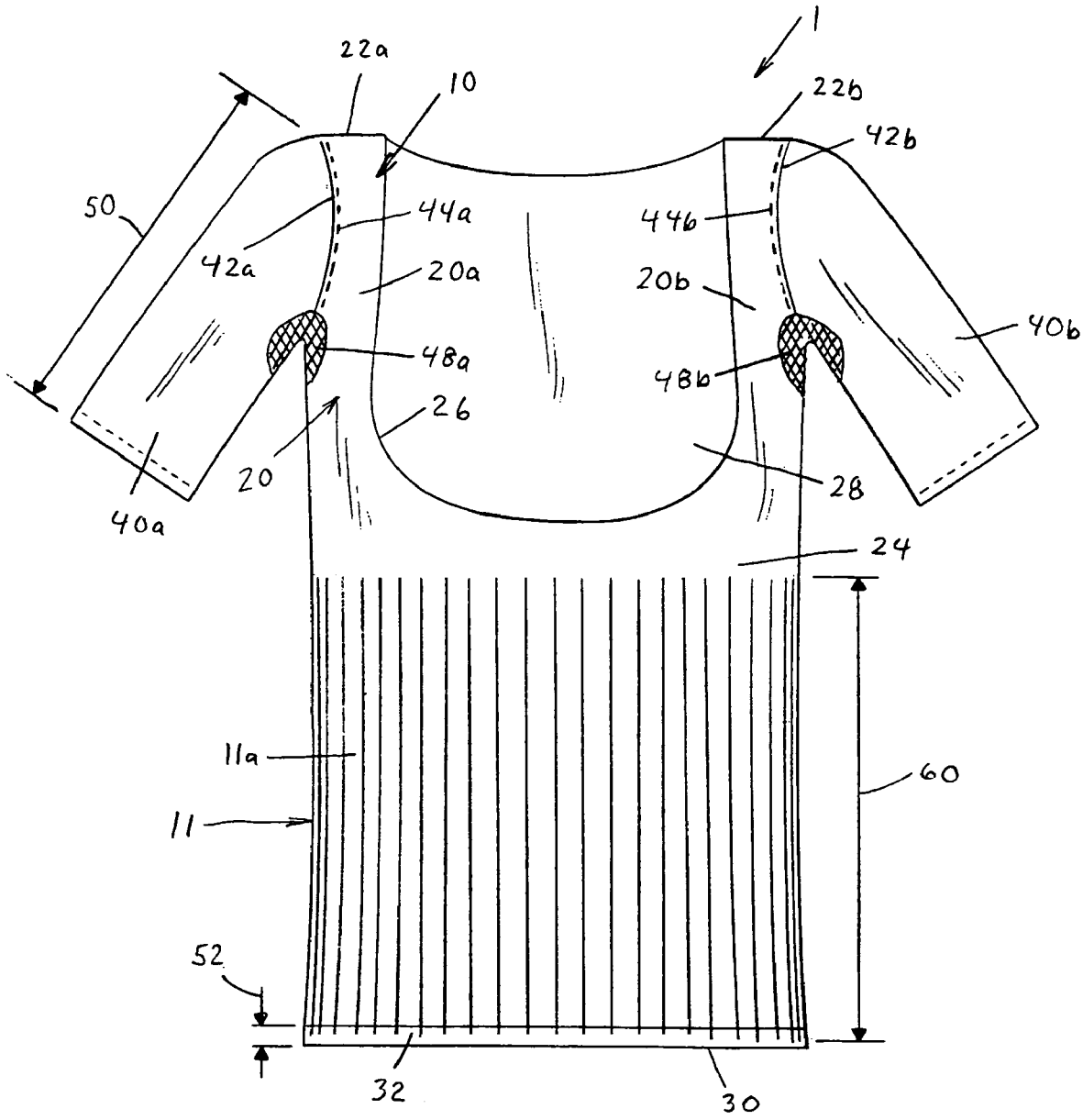
FIG. 1 is a front-view of a shapewear garment constructed in accordance with certain aspects of the invention.

With reference to the figures, which are intended to be illustrative, and not limiting, FIG. 1 shows a garment 1 constructed in accordance with certain aspects of the invention. Garment 1 includes an upper portion 10 that is generally smooth and a lower portion 11 that features a reinforced treatment portion 11*a*.

Upper portion 10 includes a bodice 20 having bodice sections 20*a* and 20*b* on either side of a neckline 26. Further bodice 20*a* and 20*b* extending from shoulder portions 22*a* and 22*b*, respectively, to a general transition region 24 dividing upper portion 10 from lower portion 11. In one embodiment, neckline 26 is a U-shaped neckline that defines an open breast region 28 that extends below the wearer's breasts and an associated bra so that the breasts are not compressed by garment 1. While in this embodiment breast region 28 is an open region, this region can include a breast support fabric configuration (not shown) that supports the wearer's breasts without overly compressing the breasts.

Lower portion 11 extends from transition region 24 to a bottom 30 and in one embodiment ribbed portion 11*a* extends from beneath the bottom of U-shaped neckline 26 and the wearer's breasts to bottom 30 of the garment. In other embodiments of this application, ribbed portion 11*a* does not cover the entire lower portion including, but not limited to, ending before bottom 30. Lower portion 11 can further include a reinforced hem 32 which includes a reinforced band at or near bottom 30. This band can include a double layer of the material used to form garment 1. This hem or band can be a wide band to further help shape the wearer's torso. In this respect, the hem can be over 1 inch wide and can extend about the entire torso. Based on some wearer's bodies and styles, the hem could be several inches wide. It has been found that this hem works particularly well if it is between 1 and 3 inches wide.

Garment 1 can further include sleeves 40*a* and 40*b* that are attached at shoulder openings 42*a* and 42*b*, respectively of bodice 22. These arms can be attached by any means known in the art including, but not limited to by seams 44*a* and 44*b*, respectively, which wrap from the shoulder and under the armpit wherein garment 1 can further include a breathable arm pit area 48*a* and 48*b* that can be formed by the same material or a mesh weave. Sleeves are formed by a stretchable material thereby controlling or compressing the wearer's arms. In one embodiment, the sleeves are made from seamless technology know in the art to help prevent the visible seam. In another embodiment, the seams of the sleeves are reinforced to smooth out and support the wearer's arm fat also producing a streamlined appearance.

Figure 2:
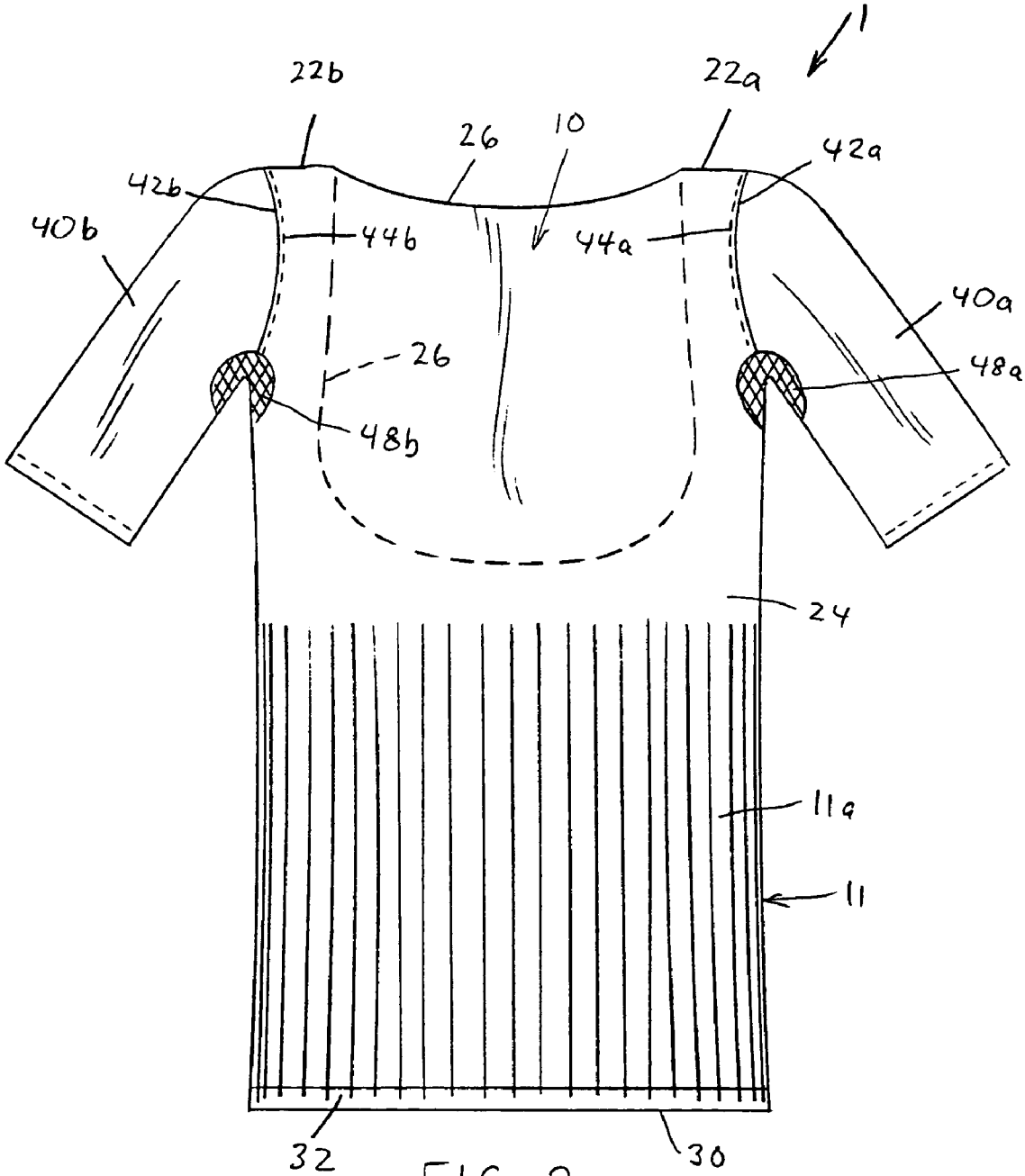
FIG. 2 is a back view of the shapewear garment shown in FIG. 1.

With reference to FIG. 2, neckline 26 can be a moderate neckline on the back side. As can be appreciated, neckline 26 can be made into a wide variety of styles without detracting from the invention of this application including, but not limited to a more extreme U-shaped back neckline to accommodate a wider variety of dress and clothing styles.

Region 24 where upper portion 10 and lower portion 11 meet can be a seamless region wherein there is little or no visible signs of this transition thereby minimizing the appearance that an undergarment is being worn. Further, garment 1 can have an extended midriff section without detracting from the invention of this application.

Garment 1 can be made from any material known in the art including, but not limited to, a combination of nylon and a spandex yarn, or other conventional knitted fabrics, such as, for example, LYCRA® spandex, cotton, etc.

The upper portion of garment 1 can be manufactured using seamless technology. This allows for more stretchability and support around the wearer's middle for smoother and more shapely results. The sleeves can be sewn onto the garment using any known techniques.

The length of the bodice 20 varies for petite, average and tall women allowing for multiple lengths appropriate to wear discretely or as a layering device under shirts and blouses as well as skirts. Further, sleeves 40*a* and 40*b* have a length 50 that can also vary based on the size of the wearer. However, length 50 can also vary based on the style of the outfit for use with garment 1 and fashion trends. As with the dimensions discussed above, other dimensions can vary based on the style of clothing worn over top of garment 1, the size and shape of the wearer, and other fashion trends. In this respect, reinforced hem 32 can have a width 52 extending vertically that can vary and it has been found that widths in the ranges of 1 to 3 inches works particularly well.

However, those skilled in the art will understand that the widths and lengths of the garment are not limited to any particular widths and lengths.

The lower or midriff section 11 is reinforced using a ribbed and/or thicker treatment 11*a* to provide additional support for the middle area and to provide more support to help the garment stay in place. The differences between this area and the smoother areas of upper section 10 are indicated by the vertical lines, i.e., the thin vertical lines reference the ribbed or thicker portion of the garment. Again, portion 11*a* can vary in dimension based on the size and shape of the wearer along with other fashion considerations without detracting from the invention of this application. As is shown the ribbed portion has a length 60 extending from at or near bottom 30 to at or near transition 24.

Figure 3:
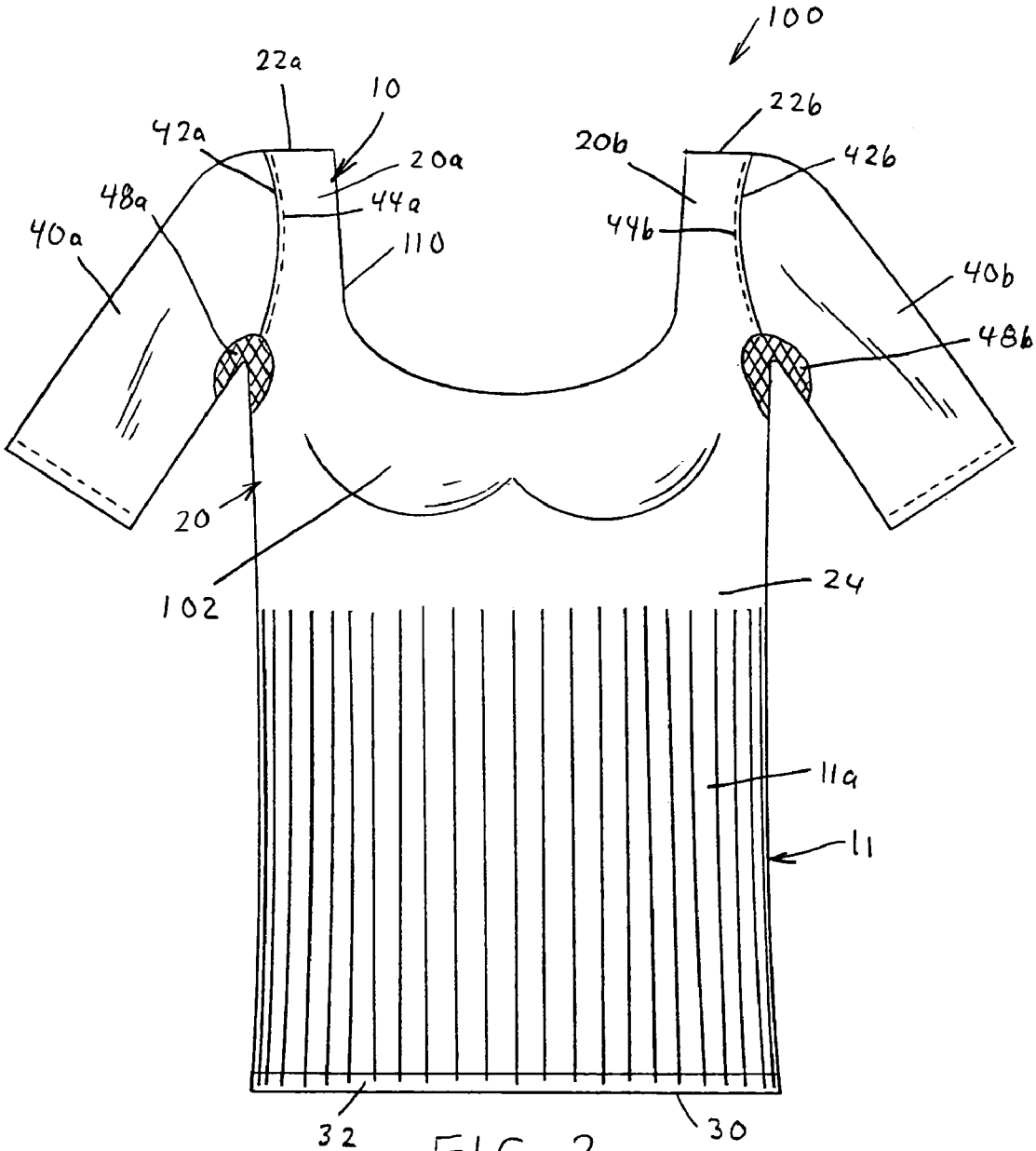
FIG. 3 is an additional embodiment of the shapewear garment of FIG. 1 and FIG. 2 in accordance with other aspects of the invention.

With reference to FIG. 3, shown is garment 100 including alternative embodiments of the invention of this application. In order to simplify the disclosure of this application, like reference numbers are included in FIG. 3 for elements that can be the same as those discussed above with respect to FIGS. 1 and 2. In this embodiment, garment 100 includes a chest covering bralette 102 that allows for gentle support of the breasts without overly compressing the breasts.

Garment 100 further includes a neckline 110 of another embodiment of the present invention wherein neckline 110 that can also be a U-shaped neckline however, it extends above the chest area such that bralette 102 at least partially covers the breasts for comfortable support in lieu of compression or, alternatively, no coverage as in FIG. 1. However, bralette 102 is configured to lift and support the breasts as opposed to compressing the breasts as does the remaining portions of garment 100. Garment 100 can be identical to garment 1 in all other respects. Therefore, again, a detailed discussion of garment 100 is not being provided in the interest of brevity.

Those skilled in the art will understand that the present invention is not limited with respect to the denier or yarns used for the different portions of the garments. The selections, yarns and deniers specified above are simply the preferred embodiments. Those skilled in the art will understand that many modifications may be made to the present invention and that all such modifications are within the spirit and scope of the present invention.

OPERATION

In operation, one wears garment 1 or 100 underneath the user's shirt to support and gently compress the user's flab/fat. Wearing the appropriate size of the garment results in the following effects:

(1) The arm flab is lifted and gently compressed allowing for a more attractive, contoured shape;

(2) The ribbed portion supports and smoothes fat in the midriff area creating the illusion of a slimmer torso;

(3) The product helps reduce unsightly bra lines and minimizes the appearance of back fat.

While considerable emphasis has been placed on the preferred embodiments of the invention illustrated and described herein, it will be appreciated that other embodiments and/or equivalents thereof can be made and that many changes can be made in the preferred embodiments without departing from the principles of the invention. Accordingly, it is to be distinctly understood that the foregoing descriptive matter is to be interpreted merely as illustrative of the invention and not as a limitation.

It is claimed:

1. A shapewear undergarment comprising:

a tubular portion formed by a stretchable fabric, said tubular portion extending upwardly from a bottom edge of said garment and extending past a waist region of an associated torso of a wearer thereby producing compression and control of the associated torso;

a bodice extending upwardly from said tubular portion formed by a smooth and stretchable material and providing compression and control of the associated torso;

a reinforced portion formed by a strengthened control fabric positioned in a midriff region thereby providing extra control to a waist of the associated torso, said bodice being spaced from the breasts of the associated torso such that said garment does not compress the breasts of the associated torso wherein said spacing from said breasts is formed by a generally U-shaped neckline opening in said bodice extending below the associated breasts and having a moderate neckline on a back side of the associated torso such that the moderate neckline is positioned above the generally U-shaped neckline opening along an associated back of the associated torso.

2. The shapewear undergarment of claim 1, wherein said spacing from said breasts is formed by an opening in said bodice and said undergarment further including a bralette in said opening for lifting and supporting the associated breasts without substantial compression of the associated breasts.

3. The shapewear undergarment of claim 1, further including sleeves extending from said bodice, said sleeves being formed by a stretchable material thereby producing compression and control of associated arms.

4. The shapewear undergarment of claim 3, wherein said sleeves are seamless.

5. The shapewear undergarment of claim 3, wherein said sleeves include reinforced seams to smooth out the seam line.

6. The shapewear undergarment of claim 3, wherein said undergarment further includes a mesh under arm portion.

7. The shapewear undergarment of claim 1, wherein said undergarment is made from at least one of a nylon and a spandex yarn.

8. The shapewear undergarment of claim 1, wherein said reinforced portion includes a ribbed portion formed by a control fabric that is ribbed and stretchable.

9. The shapewear undergarment of claim 1, wherein said reinforced portion is substantially formed by a ribbed portion.

10. The shapewear undergarment of claim 8, wherein said ribbed portion includes vertically extending ribs.

11. The shapewear undergarment of claim 1, wherein said bodice is substantially seamless.

12. The shapewear undergarment of claim 1, further including a reinforced hem near said bottom wherein said hem applies increased compressive forces to the associated torso.

13. The shapewear undergarment of claim 12, wherein said hem is at least 1 inch wide.

14. The shapewear undergarment of claim 12, wherein said hem is between 1 and 3 inches wide.

15. The shapewear undergarment of claim 12, wherein said hem is positioned on said garment to fit below an associated navel of the associated torso.

16. A shapewear undergarment comprising:

a tubular portion formed by a stretchable fabric, said tubular portion extending upwardly from a bottom edge of said garment and extending past a waist region of an associated torso thereby producing compression and control of the associated torso;

a bodice extending upwardly from said tubular portion formed by a smooth and stretchable material and providing compression and control of the associated torso, said bodice having a generally U-shaped neckline extending above associated breasts of the associated torso such that said garment does not compress the associated breasts of the associated torso;

a chest covering bralette is provided for lifting and supporting the associated breasts without substantial compression of the associated breasts;

a reinforced portion formed by a strengthened control fabric positioned in a midriff region thereby providing extra control to a waist of the associated torso;

a reinforced hem near said bottom wherein said hem applies increased compressive forces to the associated torso;

sleeves extending from said bodice, said sleeves being formed by a stretchable material thereby producing compression and control of associated arms of the associated torso; and at least one mesh under arm portion under the sleeves.

17. The shapewear undergarment of claim 16, wherein the bodice incudes a generally U-shaped back neckline that extends towards the bottom edge of the tubular portion and being generally lower than the neckline extending above the associated breasts.

18. A shapewear undergarment comprising:

a tubular portion formed by a stretchable fabric, said tubular portion extending upwardly from a bottom edge of said garment and extending past a waist region of an associated torso of a wearer thereby producing compression and control of the associated torso;

a bodice extending upwardly from said tubular portion formed by a smooth and stretchable material and providing compression and control of the associated torso;

a reinforced portion formed by a strengthened control fabric positioned in a midriff region thereby providing extra control to a waist of the associated torso, said reinforced portion includes a ribbed portion formed by a control fabric that is ribbed and stretchable and said bodice being spaced from the breasts of the associated torso such that said garment does not compress the breasts of the associated torso wherein said spacing from said breasts is formed by a generally U-shaped neckline opening in said bodice extending below the associated breasts.

* * * * *